US006164307A

United States Patent [19]

Byles

[11] Patent Number: 6,164,307

[45] Date of Patent: Dec. 26, 2000

[54] NON-CIRCULATING, RAPID, HOT TAP WATER APPARATUS AND METHOD

[75] Inventor: Joe D. Byles, Fresno, Calif.

[73] Assignee: NIBCO Inc., Elkhart, Ind.

[21] Appl. No.: 09/323,361

[22] Filed: Jun. 1, 1999

Related U.S. Application Data

[60] Provisional application No. 60/108,149, Nov. 12, 1998.

[51] Int. Cl.[7] ..... F16L 53/00

[52] U.S. Cl. ..... 137/1; 137/337; 137/624.11

[58] Field of Search ..... 137/334, 337, 137/624.11, 59, 62, 1

[56] References Cited

U.S. PATENT DOCUMENTS

| | | | |
|---|---|---|---|
| 3,317,706 | 5/1967 | Fischer | 137/337 |
| 3,812,872 | 5/1974 | Block et al. | 137/62 |
| 4,055,147 | 10/1977 | Fletcheer et al. | 137/624.11 |
| 4,635,668 | 1/1987 | Netter | 137/62 |

*Primary Examiner*—A. Michael Chambers
*Attorney, Agent, or Firm*—Price, Heneveld, Cooper, DeWitt & Litton

[57] ABSTRACT

Apparatus for attachment to a plumbing system having a warm water outlet, for rapidly delivering hot water through the plumbing system to the warm water outlet, comprising a diverter valve attachable to a building water pipe upstream of the warm water outlet for purging cold water from the water pipe, a diverter pipe section extending from the diverter valve, a back flow preventer in flow relationship with the diverter pipe section, and a flow control regulator in flow relationship with the diverter pipe section, whereby a small controlled flow of cold water may be diverted from the water pipe to thereby cause rapid delivery of warm water to the warm water outlet when actuated.

18 Claims, 3 Drawing Sheets

NON-CIRCULATING, RAPID, HOT TAP WATER APPARATUS AND METHOD

This invention relates to potable water plumbing systems, and more particularly to an apparatus and method for providing rapid hot water from a tap of a potable water system. This application claims priority from provisional application Ser. No. 60/108,149, filed Nov. 12, 1998.

BACKGROUND OF THE INVENTION

A common problem with potable water systems which have an associated water heater is that once the tap, valve or faucet controlling the flow of the water from the heat source is turned off, the water which is left in the line between the valve and the heater container gradually cools over time. If a sufficient amount of time has elapsed before the hot water from that tap is again required, the user must wait until the cooled water within the line is evacuated through the drain and the line is once again filled with warm water. This wait can be frustrating as it can require up to several minutes for the line to be evacuated and again filled with warm water. This water is wasted down the drain and the user must wait to shower or wash his or her hands. This problem can be particularly troublesome for large, single story homes, which tend to be more spread out than multilevel homes, where the water heater can be great distances from the farthest tap. It is not uncommon to have to wait several minutes for the cooled water in the line to evacuate before the warm water arrives at the tap location. This is repeated over and over if the water is allowed to cool again prior to usage.

Several solutions to this problem have been tried in order to provide quick warm water at remote taps from the water heating device. One such solution is a recirculating system in which a return line is plumbed from the most remote tap back to the water heater source with a recirculating pump installed to provide a continuous flow of water. The flow ensures a supply of warm water contained in the plumbed line so that whenever the tap is turned on, warm water flows. This type of system is usually constructed with a controller so that when the temperature within the line drops below a certain point, the pump is automatically activated until the water temperature rises. This cycling continues as needed. Typical flow rates of these recirculating pumps are in the range of four gallons per minute. While this type of system does provide warm water in the supply line, it has several drawbacks. First, the system is expensive to install and maintain. In addition to the return line, an electrical pump is usually installed. The pump must be maintained and is subject to failures. Also, the pump creates flow at a relatively high rate which leads to premature plumbing failures from erosion corrosion. In addition, there is an increase in electrical costs associated with the pump and the additional load on the water heater. However, by far the largest drawback is the up front cost of installing such a system.

A second form of solution to this problem is a point source instant hot water device. Such devices are typically installed directly below the tap where the hot water is desired. The supplemental point source heating device is electrical and expensive to install. The point source also provides rapid hot water only to the single tap, while the recirculating pump and loop described in the previous paragraphs can provide rapid hot water to all taps and valves off the main trunk line. The point source device usually has a small storage capacity of several gallons and can be set to provide boiling water on command. The main drawbacks of such a device are the initial cost, installation requirements, energy costs, and localized effect to one tap or valve. Scalding of a user's hands can also be a concern.

A third form of device installed to provide warm water to the outlets is a convective circulating loop. This device operates on the principal that in a closed, recirculating loop warm water will rise and cool water will fall, providing a continuous recharge of warmed water into the loop, from which taps and valves are operated. This system is installed by running a return loop segment from the farthest hot water tap back to the water heater. A venturi is provided to initiate flow, and a check valve is included to prevent back flow of water in the return line when the cold tap is operated. This device helps to save water as there is no waiting for warm water to take a shower or wash hands. It is estimated that a typical family of four will waste from 7,000 to 14,000 gallons of water per year letting the tap or shower run to receive warm water. While the device does save water, the main reason people utilize the technology is not having to wait for the warm water, i.e., the convenience factor. Another benefit of the system is that it does not require electricity to operate. The flow loop is driven by natural convective forces. The plumbed return loop enters the cold water line just before the water heater device. While this device does keep the water line filled with warm water, there are several limitations and drawbacks. First, in order to operate, the return loop must be above the water heater. If the system is installed in a typical one-story slab home with the potable water plumbing installed through the slab, then the necessary rise of warmed water and fall of cooled water will not take place. The device is therefore limited to usage in multilevel homes with the plumbing occurring above the heated water source. Another disadvantage of the system is the cost of running the return loop line in an existing home. The return loop can be tricky as it must traverse through the attic or floor joists and drop down to the water heater location. The line must then be attached to the cold water inlet of the water heater. This installation requirement limits the applications to professional plumbers or only the most adept homeowners. The main hindrance to the technology is the cost of installing the return loop and the hassle associated with it.

All of the systems described above are costly to purchase and install. All typically require the services of a professional plumber for installation. The first two systems require electricity to operate, and the third system requires the plumbing to be above the heated water source to operate. Even with these drawbacks, large numbers of these systems are installed for the convenience of having rapid warm water at all taps.

No one method of providing rapid hot water to taps has been devised which is easy, economical to install, and works without electricity in all locations.

SUMMARY OF THE INVENTION

It is therefore a general object of the invention to provide a novel, rapid, hot water delivery apparatus to overcome the above-described limitations and other problems associated with prior devices for providing rapid hot water from a plumbing system.

In order to accomplish this objection, the apparatus according to the invention includes a diverter valve, preferably a self-piercing needle valve assembly, a length of diverter pipe section, preferably a small diameter pipe, e.g., one-quarter inch plastic pipe, a back flow preventer such as an anti-siphon or check valve assembly, a flow control regulator to meter a pressurized water stream as it flows through the device, and an optional control device consisting of an automated valve assembly to turn the flow of water from a source on or off at timed intervals. The components can be manufactured from an appropriate plastic or metal material. For instance, the plastic pipe is typically extruded polyethylene with a one-quarter inch outer diameter. The flow controller and anti-siphon can be molded from either polyethylene or other suitable plastic such as polypropylene. The self tapping needle valve is typically made of a metal such as brass and/or stainless steel. In production, the back flow prevention device and flow control device can be injection molded into one compact device housing both items. The back flow prevention device may be that which is typically used as irrigation anti-siphon devices. The control device is typically a battery operated plastic device with a timer clock and valve actuation device such as a solenoid which allows the flow of water to be turned on or off at set intervals.

The apparatus described above is installed as follows, providing rapid hot water to all taps and valves along the run within a home or installation:

1. The tap farthest from the water heater source is preferably selected as the installation site for the apparatus.

2. The self-piercing needle valve is attached and tapped into the hot water line source (typically one-quarter to one-half inch copper line) associated with the tap selected in step 1 above.

3. An adequate length (typically one to two feet) of small diameter tubing (plastic or metal) is attached to the needle valve through a compression fitting and threaded nut assembly.

4. The flow metering and back flow prevention device are cut into and attached to the line through an appropriate barb or compression fitting. The flow metering and back flow prevention device are now in series with the small diameter tubing running from the self-piercing needle valve assembly. The optional control device, if installed, would be installed at this point also in series with the metering and back flow prevention device through appropriate fittings.

5. A hole, e.g., one-quarter inch in diameter, is drilled into an adjacent drain associated with the sink location where the apparatus is installed.

6. The distal end of the small diameter tubing with the metering device, back flow prevention device and optional control device in series is then inserted into the hole drilled into the drain and sealed to provide a water tight seal with the drain.

Once the system apparatus is installed, the self-piercing needle valve can be opened, sending a controlled, minute flow from the hot water line into the adjacent drain location.

THEORY OF OPERATION

The apparatus is installed in a manner to provide a controlled, continuous low flow purging of the cooled water within the hot water line of a plumbing system. The continuous low flow purging of the cooled water is accomplished by the controlled, calibrated release of water from the farthest tap location into the adjacent drain of the sink associated with that tap. The low flow is approximately 0.5 to 4 gallons per hour, with 2 gallons being commonly utilized in experimental installations. The low flow allows the cooled water at the farther end of the tap to escape into the drain, the escaped water being continuously replaced by warmer water from the water heater device. It has been experimentally determined that as the rate of the escaped water increases, the register time for hot water taps off the line goes down. For instance, if the water escape rate is 0.5 gallon per hour (0.008 gpm), then the average time in an experimental installation for hot water to arrive at the farthest tap was reduced from approximately 120 seconds down to 65 seconds. When the escape rate of the water was increased to 1 gallon (0.016 gpm), the time was further reduced to approximately 45 seconds. When the escape rate was increased to 2 gallons per hour (0.033 gpm), the time was even further reduced to approximately 6 seconds. As water flows through the needle valve and the device, the back flow prevention device prevents any potential for reverse flow from the drain into the potable hot water line. This potential reverse flow would only occur if there was standing water in the drain and there was a negative pressure in the feed line due to a main water breakage, etc.

The water consumption of the device through escape of the cooled water through the line varies with the setting of the flow metering device. If it is set for a flow rate of 1 gallon per hour (0.016 gallon per minute), then the yearly consumption of water would be approximately 8,760 gallons, if run continuously. However, that consumption of water is potentially offset and overcome by an estimated savings of 7,000 to 16,000 gallons of water per year by avoidance of running taps and showers initially to receive warm water. Potential water savings can be further enhanced by utilizing the controller device and automatically turning on the purge feature in the morning prior to any usage activity, and turning off the purge activity at night following any potential usage. In a worst case scenario, the device utilizes more water than it saves, but still has the significant benefit of reducing the wait time for warm water at the farthest taps.

Once installed, the system can be turned on or off by merely closing or opening the self-piercing needle valve of the installation. Also, on/off can be controlled easily through the automatic control device as described above.

In another form of the invention, the purged water can be sent to a container and reintroduced into the cold water line via a venturi device. The water can also be routed to useful areas such as a garden or lawn area where it can be usefully consumed by plant material or stored for later usage.

A summary of the benefits of this system over other prior art systems include:

1. Apparatus cost is a fraction of all other systems, total parts about $15.

2. Installation time is a fraction of all other systems, about 10 minutes.

3. Installation does not require a plumber.

4. Installation does not require extra plumbing back to the water heater.

5. Apparatus does not require electricity to operate.

6. Apparatus provides adjustable timing for hot water wait.

7. Apparatus operates on low level purge, therefore no stress on piping systems.

8. System will operate on single story homes built on a slab.

9. System can save water.

10. System does not require the mixing of hot and cold streams.

11. System does not normally re-introduce water to potable stream, but places it into drain and waste vent system, therefore not having potable water system requirements.

12. If there is a split line in two directions off the water heater, a device can be installed at the termination sink area of both directions, providing continuously available hot water in both directions.

13. The apparatus can be installed on multiple branches of the hot water line and tuned to provide calibrated hot water to each branch.

These and other features, advantages and objects of the present invention will be further understood and appreciated by those skilled in the art by reference to the following specification, claims and appended drawings.

DESCRIPTION OF THE PREFERRED EMBODIMENTS

Figure 1:
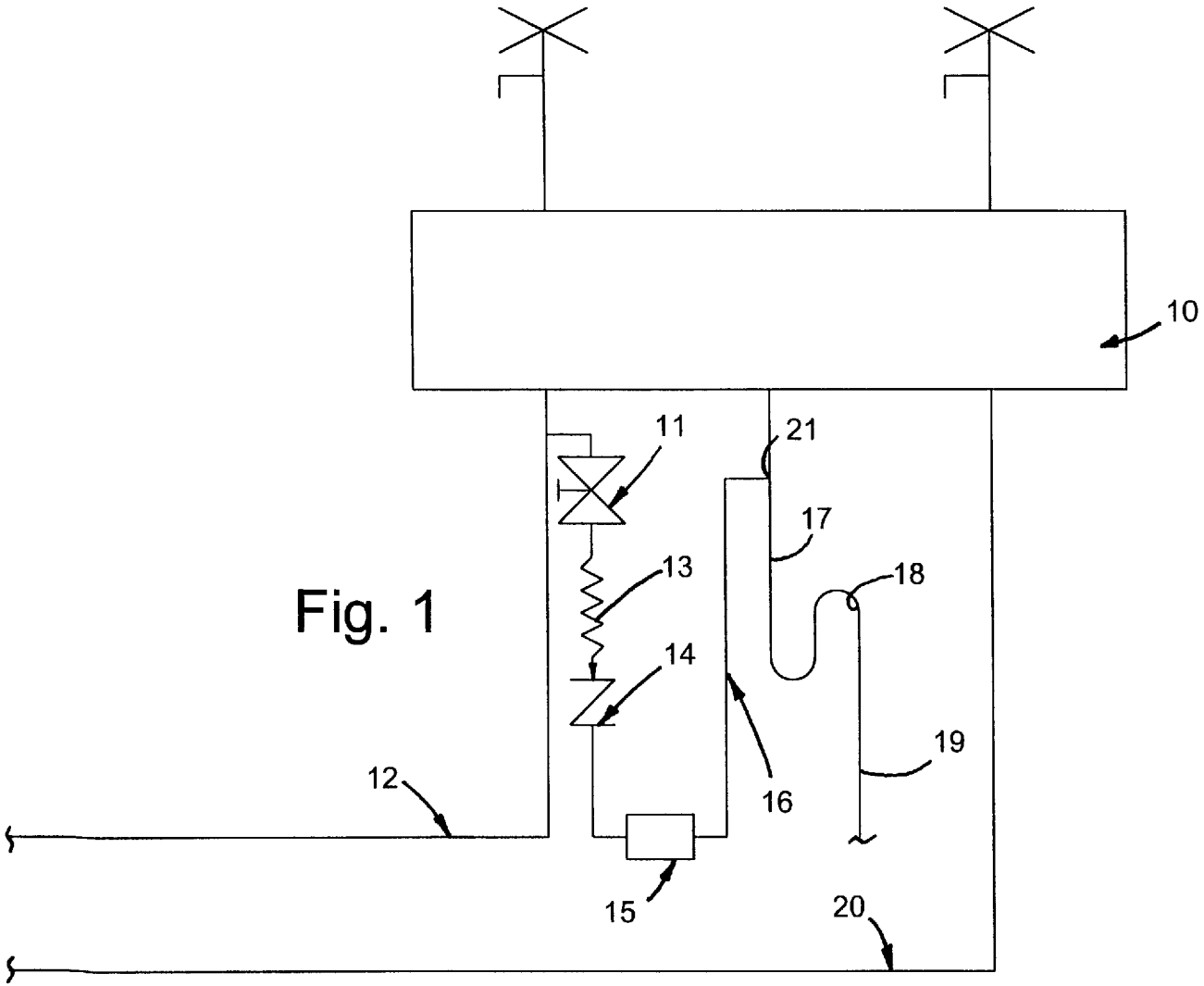
FIG. 1 is a schematic view of the apparatus installed with all of the elements schematically shown.

FIG. 1 shows a schematic view of the apparatus installed at a sink 10 with all of the elements shown. The installation shows the self-piercing needle valve 11 attached to the hot water supply line 12, the flow metering device 13, the anti-siphon device 14, and the optional control device 15. The optional control device 15 is an electric or mechanical timer which can turn the flow through the apparatus on or off by use of a valve. The control device is typically battery powered but can also be mechanical or plugged into an electrical outlet. The elements of the installation are shown connected with a one-quarter inch plastic tube 16 which is inserted into the drain line 17 above the gap trap 18 of the sink drainage line 19. The cold water line is shown as 20. The location point 21 where the one-quarter inch tube is attached is sealed with a sealant. It is understood that attachment point 21 could also bypass drain 19 and go to a container, or outside to a beneficial use point as in a garden, storage tank, etc.

Figure 2:
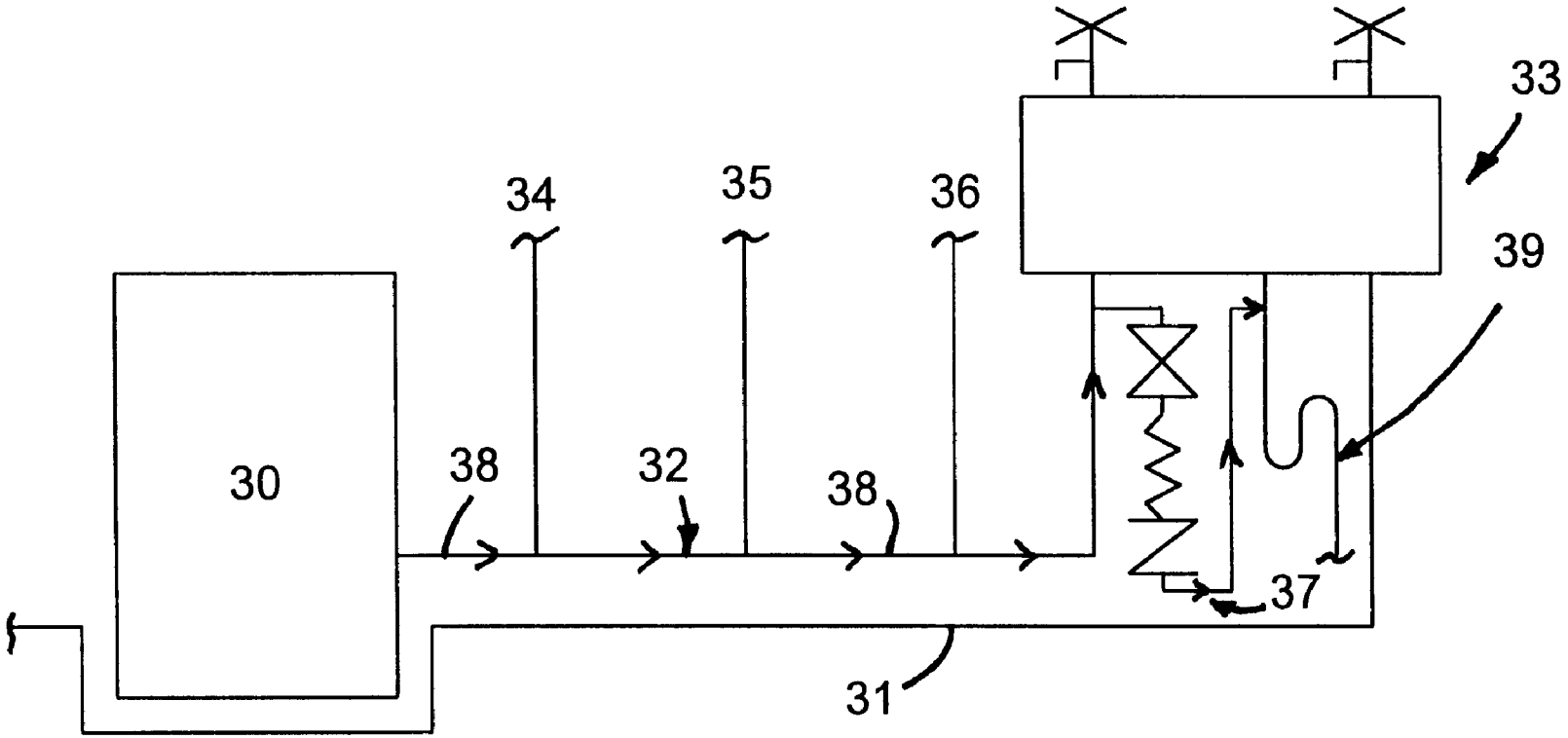
FIG. 2 is a schematic drawing showing the flow of water through a typical plumbing system with the apparatus purging.

FIG. 2 schematically shows the system and apparatus installed with a water heater source 30. The cold water line 31 is shown entering water heater 31. The hot water line 32 is shown going to the remote sink 33 with other service points shown as 34, 35 and 36 respectively. The other points 34, 35 and 36 represent showers, dishwashers, or any other component which requires hot water from the water heater. The apparatus is shown installed and represented by 37. The purge water flow path is represented by arrows 38 along the hot water line. The water, as it cools, is purged from the hot water line 32 along path 38 into drain 39 of remote sink 33. As a result, the line is continuously refilled with hot water from water heater 30. As hot water is demanded from any source, the pipe is filled with hot water and initial purging, typically required, is not necessary.

Figure 3:
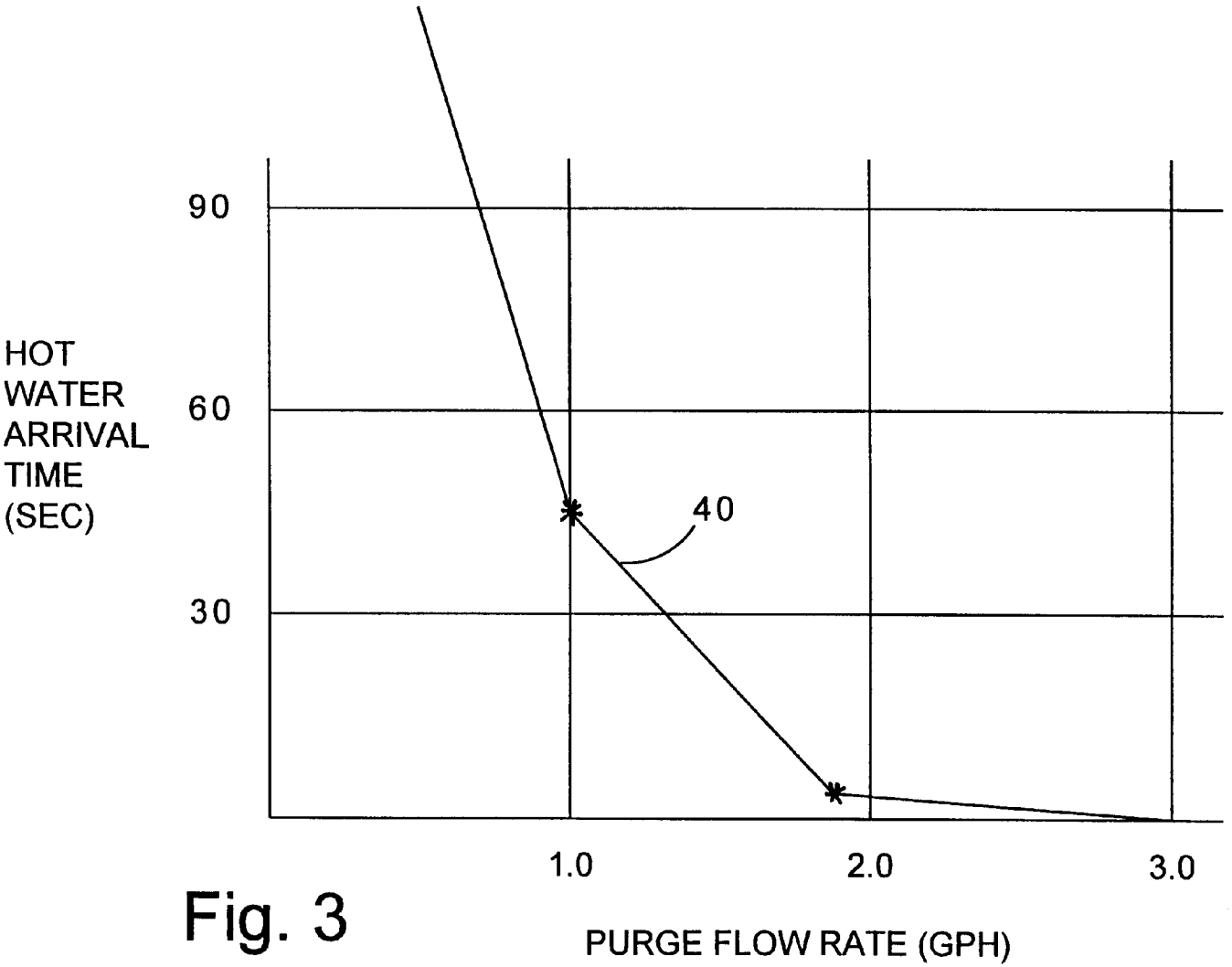
FIG. 3 is a graph showing the experimentally noted wait time versus the purge time for the system.

FIG. 3 is a graph showing experimental data obtained in a trial installation. The resultant curve 40 represents the results for wait time in seconds versus continuous purge flow rate. The curve will vary with installation details such as length of hot water line and specific plumbing characteristics, but shows observed trends.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. A method for rapidly delivering hot water through a plumbing system to a warm water outlet, comprising the steps of:

providing a building hot water supply pipe, a water heater, and a warm water outlet from said hot water supply pipe;

coupling a diverter valve to said hot water supply pipe upstream of said warm water outlet for purging cold water from said hot water pipe, and providing a diverter pipe section extending from said diverter valve; and metering a small flow of water through said diverter valve and diverter pipe section to a drain to purge cold water from said hot water supply pipe.

2. The method of claim 1 including providing a back flow preventer in flow relationship with said diverter pipe section to inhibit back flow.

3. The method in claim 1 wherein said metering step includes providing a flow control regulator in flow relationship with said diverter pipe section, whereby a small controlled flow of cold water is diverted from said hot water pipe to thereby cause rapid delivery of warm water to the warm water outlet when actuated.

4. The method in claim 1 wherein said diverter valve is a needle valve.

5. The method in claim 1 wherein said diverter valve is a pipe piercing needle valve.

6. The method in claim 1 including providing an automated on/off valve in flow relationship with said diverter pipe section, to automatically close during preselected time periods.

7. Apparatus for attachment to a plumbing system having a warm water outlet, for rapidly delivering hot water through the plumbing system to the warm water outlet, comprising:

a diverter valve attachable to a building hot water pipe upstream of the warm water outlet for purging cold water from the hot water pipe at a flow rate of from about 0.5 to about 4 gallons per hour;

a diverter pipe section extending from said diverter valve to a drain; and a back flow preventer in flow relationship with said diverter pipe section.

8. The apparatus in claim 1 including a flow control regulator in flow relationship with said diverter pipe section, whereby a small controlled flow of cold water may be diverted from the water pipe to thereby cause rapid delivery of warm water to the warm water outlet when actuated.

9. The apparatus in claim 8 including an automated on/off valve in flow relationship with said diverter pipe section, to automatically close during preselected time periods.

10. The apparatus in claim 1 wherein said diverter valve is a needle valve.

11. The apparatus in claim 1 wherein said diverter valve is a pipe piercing needle valve.

12. The apparatus in claim 1 and further including an automated on/off valve in flow relationship with said diverter pipe section, to automatically close during preselected time periods.

13. The apparatus in claim 1 wherein said back flow preventer is a check valve.

14. The apparatus in claim 1 wherein said back flow preventer is an anti-siphon device.

15. A homeowner-installable system for providing rapidly available hot water to a hot water faucet in a home comprising:

one of a sink, shower, and tub including a hot water line and a hot water faucet coupled to said hot water line;

a pipe-piercing needle valve for installation to a hot water line adjacent one of a sink, shower, and tub, with an associated hot water faucet, said valve providing a water outlet;

a drain line for coupling said water outlet of said valve to a drain pipe associated with one of a sink, shower, and tub; and a flow restrictor coupled to said drain line to restrict the flow of water from said valve to the drain.

16. The system as defined in claim 15 and further including an automated valve coupled to said drain line to selectively turn off the flow of water through said drain line during periods of time when there is no demand for hot water.

17. The system as defined in claim 16 wherein said flow restricter limits the flow of water through said drain to form about 0.5 to about 4 gallons per hour.

18. The system as defined in claim 17 and further including a back flow preventer coupled to said drain line.

* * * * *

UNITED STATES PATENT AND TRADEMARK OFFICE

CERTIFICATE OF CORRECTION

PATENT NO. : 6,164,307
DATED : December 26, 2000
INVENTOR(S) : Joe D. Byles

It is certified that error appears in the above-identified patent and that said Letters Patent is hereby corrected as shown below:

Column 6,
Lines 50, 58, 60, 62 and 66, "claim 1" should be -- claim 7 --.

Column 7,
Line 1, "claim 1" should be -- claim 7 --.

Signed and Sealed this

Twenty-sixth Day of March, 2002

*Attest:*

*Attesting Officer*

JAMES E. ROGAN
*Director of the United States Patent and Trademark Office*